US006264572B1

(12) United States Patent
Matheson et al.

(10) Patent No.: US 6,264,572 B1
(45) Date of Patent: Jul. 24, 2001

(54) SPORTS EQUIPMENT

(76) Inventors: Alistair Dominic Matheson; Andrew Michael Matheson, both of 5 High Croft Road, London (GB), N19 3AQ ( * ) Notice: Subject to any disclaimer, the term of this patent is extended or adjusted under 35 U.S.C. 154(b) by 0 days.

(21) Appl. No.: 09/394,351

(22) Filed: Sep. 13, 1999

(30) Foreign Application Priority Data

Sep. 11, 1998 (GB) ..... 9819905

(51) Int. Cl.[7] ..... A63B 69/00

(52) U.S. Cl. ..... 473/446; 473/448; 473/432; 473/55; 473/471; 273/402

(58) Field of Search ..... 473/197, 456, 473/478, 446, 448, 432; 273/127 R, 381, 407, 410

(56) References Cited

U.S. PATENT DOCUMENTS

| | | | | |
|---|---|---|---|---|
| 3,840,228 | * | 10/1974 | Greaney | 473/446 |
| 3,856,298 | | 12/1974 | Frantti . | |
| 3,887,181 | | 6/1975 | Samaras . | |
| 3,944,223 | | 3/1976 | Bromwell . | |
| 4,275,883 | * | 6/1981 | Grimaldi et al. | 473/432 |
| 4,921,257 | | 5/1990 | Heller . | |
| 4,948,147 | | 8/1990 | Pallanca . | |
| 5,181,725 | * | 1/1993 | Leras et al. | 473/446 |
| 5,271,616 | * | 12/1993 | Grimaldi | 473/432 |
| 5,413,533 | * | 5/1995 | Bolus et al. | 473/55 |
| 5,863,266 | * | 1/1999 | Starnes | 473/471 |

* cited by examiner

*Primary Examiner*—Jeanette Chapman
*Assistant Examiner*—Mita Aryarpour

(57) ABSTRACT

Equipment for use in training penalty taking. The equipment for use with a goal comprising goal posts and a cross bar defining a goal area. The goal area is partially occluded by a transparent or translucent barrier the areas harder to reach by a goalkeeper remaining unoccluded.

8 Claims, 1 Drawing Sheet

SPORTS EQUIPMENT

FIELD OF THE INVENTION

This invention relates to sports equipment for use in a ball game or as a training aid.

BACKGROUND OF THE INVENTION

Followers of soccer, notably followers of the English national team, will be aware of tie importance of accurate shots at goal, for instance when the results of otherwise drawn games are decided by a 'penal shoot out'. They will also be aware that a good penalty taker can make the difference between a side winning and losing.

Hitherto players have practised place-kicking primarily by shooting at either an open goal or one defended by a goalkeeper. The former is not a good simulation of a defended goal. The latter requires the presence of a goalkeeper and does not specifically train the footballer to shoot towards the optimal parts of the net.

BRIEF SUMMARY OF THE INVENTION

The invention seeks in one embodiment to provide a training aid to providing a simulation of a defended goal.

The invention in some embodiments seeks to provide game apparatus for use in a game of skill.

According to the invention there is provided game apparatus for use with a goal area defined by goal posts joined by a cross-bar the apparatus comprising an adjustable barrier partially occluding the goal area and secured only to the cross-bar, the barrier comprising a plurality of relatively movable leaves. The area of the barrier may be adjustable. The barrier will typically be at least partially transparent, and is referred to as such in the remainder of the text. However, it is not an absolute requirement for the barrier to be at least partially transparent, and the invention encompasses opaque barriers as well as non-opaque barriers. The barrier may comprise a plastics sheet and/or a net.

Embodiments of the invention will be illustrated by way of non-limiting example by reference to the accompanying figures of which:

DETAILED DESCRIPTION OF THE INVENTION

The invention will bc illustrated by reference to a goal for soccer. It is to be understood that the invention is not so limited. The invention can be used for training for other games such as hockey, ice hockey, polo and water polo. The invention furthermore need not be directed to a simulation of any particular existing game.

The invention requires a goal area 1 defined, in the illustrated embodiment by goal post 2 and cross bar 3.

Conveniently a net (not shown) for trapping balls or pucks is provided but it will be clear that this is not essential.

Received in the goal area 1 is a barrier 4. Barrier 4 simulates the reach of a diving goal keeper. Thus in the illustrated embodiment barrier 4 does not occlude the outer regions and top and bottom corners of the goal area which a diving goal keeper would find difficult to reach but does occlude the central portions.

A player strikes a ball and attempts to score a goal by passing it through a gap between the goal posts, cross bar and barrier. The position of the barrier forces the player to aim at the corners which are hard for the goalkeeper, in many games, to reach. This means that when called upon to take a penalty during play of a game the player is trained to play hard-to-save shots.

To reduce the possibility of distraction and make use of the invention more realistic the barrier may be transparent or translucent, although the invention also includes the possibility of opaque barriers. For example the barrier may comprise transparent plastic sheets or it may comprise netting. In some embodiments of the invention decoration for example a representation of a diving to goalkeeper may be applied to the barrier.

Figure 1:
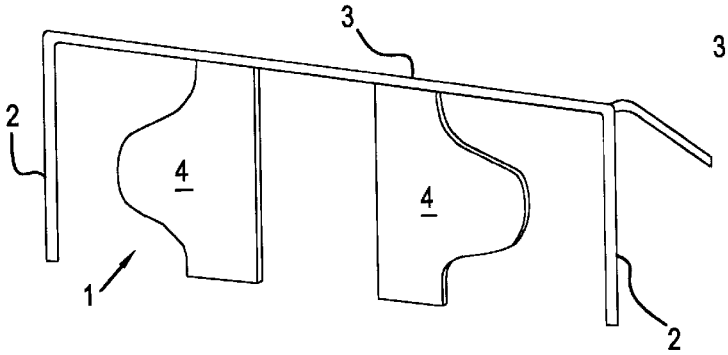
FIG. 1 is a perspective view of an embodiment of the invention.
Figure 2:
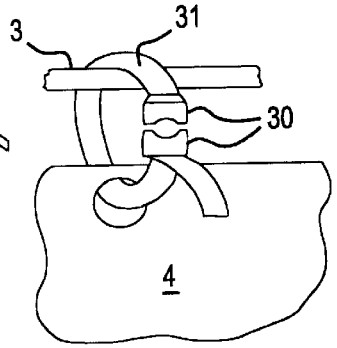
FIG. 2 is a scrap view of a fastener for use in the invention.
Figure 3:
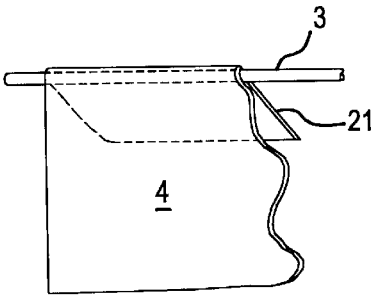
FIG. 3 is a perspective view of an alternative suspension means.
Figure 4:
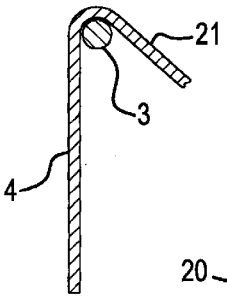
FIG. 4 is a cross section of the means of FIG. 3.

The width of the barrier can be adjustable by providing a plurality of leaves which may overlap or may as shown in FIG. 1 provide a central passage. FIG. 1 also shows the generally coplanar nature of the barrier.

In some embodiments of the invention the shape of the barrier can be adjustable by for example providing a deformable perimeter attached to a net, with the net providing the majority of the barrier.

The barrier depends from the cross bar. For example, barrier could have tail 21 hanging over the cross-bar. In this embodiment the barrier will need a degree of rigidity so that it will not fall from the cross-bar.

Figure 5:
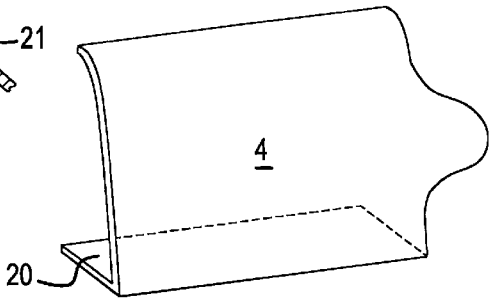
FIG. 5 is a perspective view of another embodiment of the invention.
Figure 6:
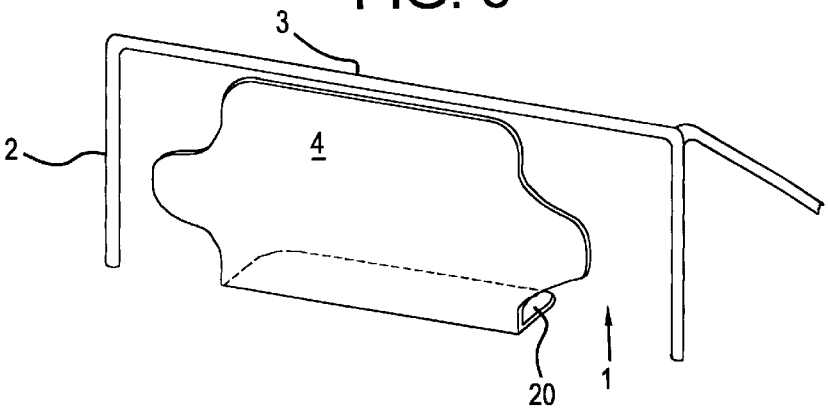
FIG. 6 is a perspective view of yet another embodiment of the invention.

FIG. 5 shows one of the barriers of FIG. 1 with a flap 20 extending from a bottom of the barrier. FIG. 6 shows a one piece barrier 4 with a flap 20 positioned in the goal area 1.

In other embodiments of the invention a buckle 30 and strap 31 of the kind sometimes used in rucksacks may be provided. The strap passes through holes in the barrier which may be reinforced at or about the holes. Other means of securing the barrier such as hooks or velcro™ straps will suggest themselves to the skilled.

While the invention has been described by reference to a training aid it will be apparent that the invention is not so limited. The apparatus can be used for game play. In a one player game a player may for example seek to score as many goals as possible. In a multiplayer game each player may be allowed a specified number of attempts the player converting the greatest number being the winner. In another embodiment the players take turns to take attempts with players being eliminated when they fail to convert.

Those skilled will have little difficulty in devising modifications.

What is claimed is:

1. Game apparatus suitable for use with a goal area, the goal area being defined by goal posts joined by a cross-bar the apparatus comprising an adjustable barrier partially occluding the goal area and securable to the cross-bar, the barrier comprising a plurality of generally coplanar and movable leaves, a portion of a perimeter of the barrier adjacent a vertical goal post extending toward the vertical goal post to form an undulating peripheral edge along said perimeter, the portion of the perimeter and the barrier exposing at least one corner region of the goal area while blocking central regions of the goal area.

2. Game apparatus as claimed in claim 1 wherein the barrier is at least partially transparent.

3. Game apparatus as claimed in claim 1 wherein the barrier comprises a plastics sheet.

4. Game apparatus as claimed in claim 2, wherein the barrier comprises a plastic sheet.

5. Game equipment comprising:

a) goal posts;

b) a cross-bar between the goal posts, the cross bar and goal posts defining a goal area; and c) an adjustable barrier partially occluding the goal area and securable to the cross-bar, the barrier comprising a plurality of generally coplanar and movable leaves, a portion of a perimeter of the barrier adjacent a vertical goal post extending toward the vertical goal post to form an undulating peripheral edge along said perimeter, the portion of the perimeter and the barrier exposing at least one corner region of the goal area while blocking central regions of the goal area.

6. Game equipment of claim 5, wherein the barrier is at least partially transparent.

7. Game equipment of claim 5, wherein the barrier comprises a plastic sheet.

8. Game equipment of claim 6, wherein the barrier comprises a plastic sheet.

* * * * *

UNITED STATES PATENT AND TRADEMARK OFFICE

CERTIFICATE OF CORRECTION

PATENT NO. : 6,264,572 B1
DATED : July 24, 2001
INVENTOR(S) : Matheson et al.

It is certified that error appears in the above-identified patent and that said Letters Patent is hereby corrected as shown below:

Title page,
Attorney, Firm or Agent of Record is "Clark & Brody"

Signed and Sealed this

Fifth Day of February, 2002

*Attest:*

*Attesting Officer*

JAMES E. ROGAN
*Director of the United States Patent and Trademark Office*